US008122727B2

(12) United States Patent
Shi et al.

(10) Patent No.: US 8,122,727 B2
(45) Date of Patent: Feb. 28, 2012

(54) COMPLIANT METAL SUPPORT FOR CERAMIC COMBUSTOR LINER IN A GAS TURBINE ENGINE

(75) Inventors: Jun Shi, Glastonbury, CT (US); Jason Lawrence, East Hartford, CT (US); David J. Bombara, New Hartford, CT (US); Richard S. Tuthill, Bolton, CT (US); Jeffrey D. Melman, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 204 days.

(21) Appl. No.: 12/612,764

(22) Filed: Nov. 5, 2009

(65) Prior Publication Data

US 2010/0101232 A1 Apr. 29, 2010

Related U.S. Application Data

(62) Division of application No. 11/117,599, filed on Apr. 27, 2005, now Pat. No. 7,647,779.

(51) Int. Cl.
*F02C 7/22* (2006.01)
*F23R 3/54* (2006.01)
*F23R 3/60* (2006.01)

(52) U.S. Cl. ..... 60/800; 60/739; 60/753

(58) Field of Classification Search ..... 60/800, 60/752, 737, 739, 753, 39.37
See application file for complete search history.

(56) References Cited

U.S. PATENT DOCUMENTS

| | | | | |
|---|---|---|---|---|
| 2,690,648 | A | 10/1954 | Pearce et al. | |
| 3,982,392 | A * | 9/1976 | Crow | 60/753 |
| 4,083,752 | A | 4/1978 | Bielski et al. | |
| 4,363,208 | A | 12/1982 | Hoffman et al. | |
| 4,527,397 | A * | 7/1985 | Tobery et al. | 60/757 |
| 5,083,424 | A | 1/1992 | Becker | |
| 5,085,038 | A * | 2/1992 | Todman et al. | 60/39.37 |
| 5,353,586 | A | 10/1994 | Taylor et al. | |
| 5,419,114 | A | 5/1995 | Bauermeister et al. | |
| 5,630,319 | A * | 5/1997 | Schilling et al. | 60/800 |
| 6,282,886 | B1 | 9/2001 | Sato et al. | |
| 6,571,560 | B2 | 6/2003 | Tatsumi et al. | |
| 6,708,495 | B2 * | 3/2004 | Calvez et al. | 60/753 |
| 6,732,528 | B2 | 5/2004 | Akagi et al. | |
| 7,017,350 | B2 | 3/2006 | De Sousa et al. | |
| 7,096,668 | B2 * | 8/2006 | Martling et al. | 60/800 |
| 7,237,389 | B2 | 7/2007 | Ryan et al. | |
| 2001/0035003 | A1 * | 11/2001 | Sinha et al. | 60/752 |
| 2003/0000223 | A1 * | 1/2003 | Conete et al. | 60/752 |
| 2005/0050902 | A1 * | 3/2005 | Anichini et al. | 60/800 |

FOREIGN PATENT DOCUMENTS

| | | | |
|---|---|---|---|
| EP | 1096207 | A1 | 5/2001 |
| EP | 1152191 | A2 | 11/2001 |
| EP | 1265031 | A1 | 12/2002 |
| EP | 1265032 | A1 | 12/2002 |
| EP | 1431665 | A2 | 6/2004 |
| EP | 1479975 | A1 | 11/2004 |
| FR | 2825782 | A1 | 12/2002 |
| GB | 1476414 | A | 6/1977 |

* cited by examiner

*Primary Examiner* — Ted Kim
(74) *Attorney, Agent, or Firm* — Bachman & LaPointe, P.C.

(57) ABSTRACT

A combustion system for an engine, such as a gas turbine engine is provided. The combustion system has a ceramic component, such as ceramic combustor liner, and at least one metal support component, such as a metal ring or a plurality of metal cones, for providing radial and axial support to the ceramic component. The at least one metal support component includes a structure, such as axial slots or radial slots, for minimizing stress and for increasing compliance of the metal support component with respect to the ceramic component.

15 Claims, 9 Drawing Sheets

COMPLIANT METAL SUPPORT FOR CERAMIC COMBUSTOR LINER IN A GAS TURBINE ENGINE

CROSS REFERENCE TO RELATED APPLICATION(S)

The instant application is a divisional application of U.S. patent application Ser. No. 11/117,599, filed Apr. 27, 2005, entitled COMPLIANT METAL SUPPORT FOR CERAMIC COMBUSTOR LINER IN A GAS TURBINE ENGINE, now U.S. Pat. No. 7,647,779.

BACKGROUND OF THE INVENTION (1) Field of the Invention

The present invention relates to a combustion system for an engine, such as a gas turbine engine, and more particularly, to a compliant metal support for a ceramic combustor liner used in the combustion system.

(2) Prior Art

A gas turbine engine consists of an inlet, a compressor, a combustor, a turbine, and an exhaust. The compressor draws in ambient air and increases its temperature and pressure. Fuel is added to the compressed air in the combustor to further raise gas temperature. The high temperature gas expands in the turbine to extract work that drives the compressor and other mechanical devices such as an electric generator.

To reduce $NO_x$ produced in the combustor, it is desirable to reduce flame temperature. This requires a high percentage of the compressed air to be mixed with the fuel to produce a lean fuel air mixture. Such a lean combustion reduces the air available for combustor liner cooling and/or increases pressure loss during the cooling of the combustor liner. To lower the cooling air requirement and the attendant pressure loss, high temperature ceramic materials have been proposed for combustor liners. Although ceramic materials have excellent high temperature strength, their coefficients of thermal expansion (CTE) are much lower than those of metals. Thermal stress arising from the mismatch of the CTEs poses a challenge to the insertion of ceramic combustor liner into gas turbine engines.

SUMMARY OF THE INVENTION

Accordingly, it is an object of the present invention to provide a combustor system for an engine having a ceramic component and at least one metal component with a structure for controlling the thermal stresses which are produced.

It is a further object of the present invention to provide a structure as above which spreads the local contact stress in the attachment area by using a compliant interface layer.

It is yet a further object of the present invention to provide a structure as above which stops the reaction between the ceramic component and the metal component(s) by using an interface layer that is chemically non-reactive to both the ceramic component and the metal component(s).

The foregoing objects are attained by the present invention.

In accordance with the present invention, a combustion system for an engine is provided. The combustion system broadly comprises a ceramic component, at least one metal support component for providing radial and axial support to the ceramic component, and the at least one metal support component having means for minimizing stress and for increasing compliance of the metal support component with respect to the ceramic component.

Other details of the compliant metal support for a ceramic combustor liner in a gas turbine engine, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
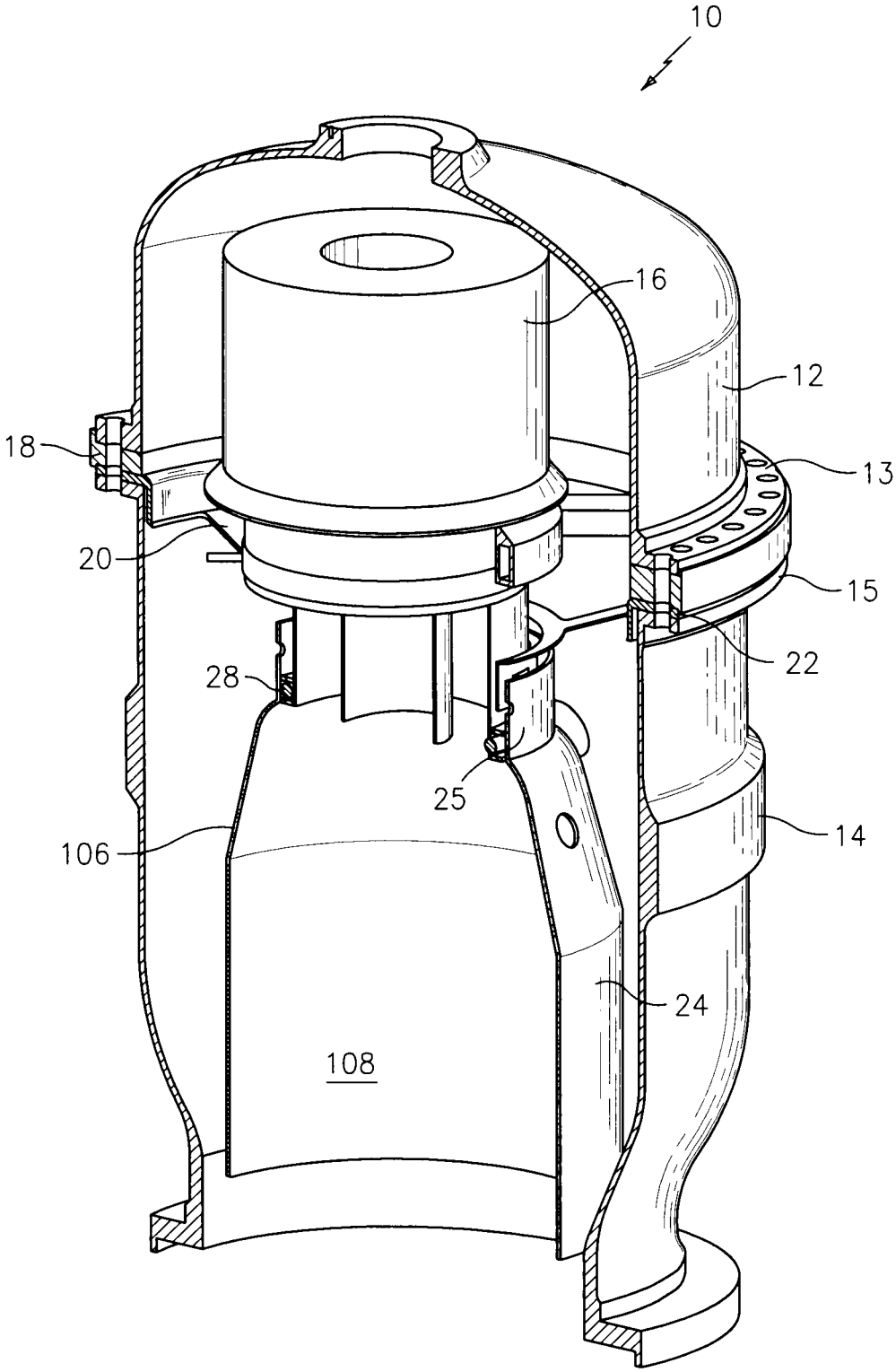
FIG. 1 is a sectional view of a ceramic combustor liner inside a metal casing.
Figure 2A:
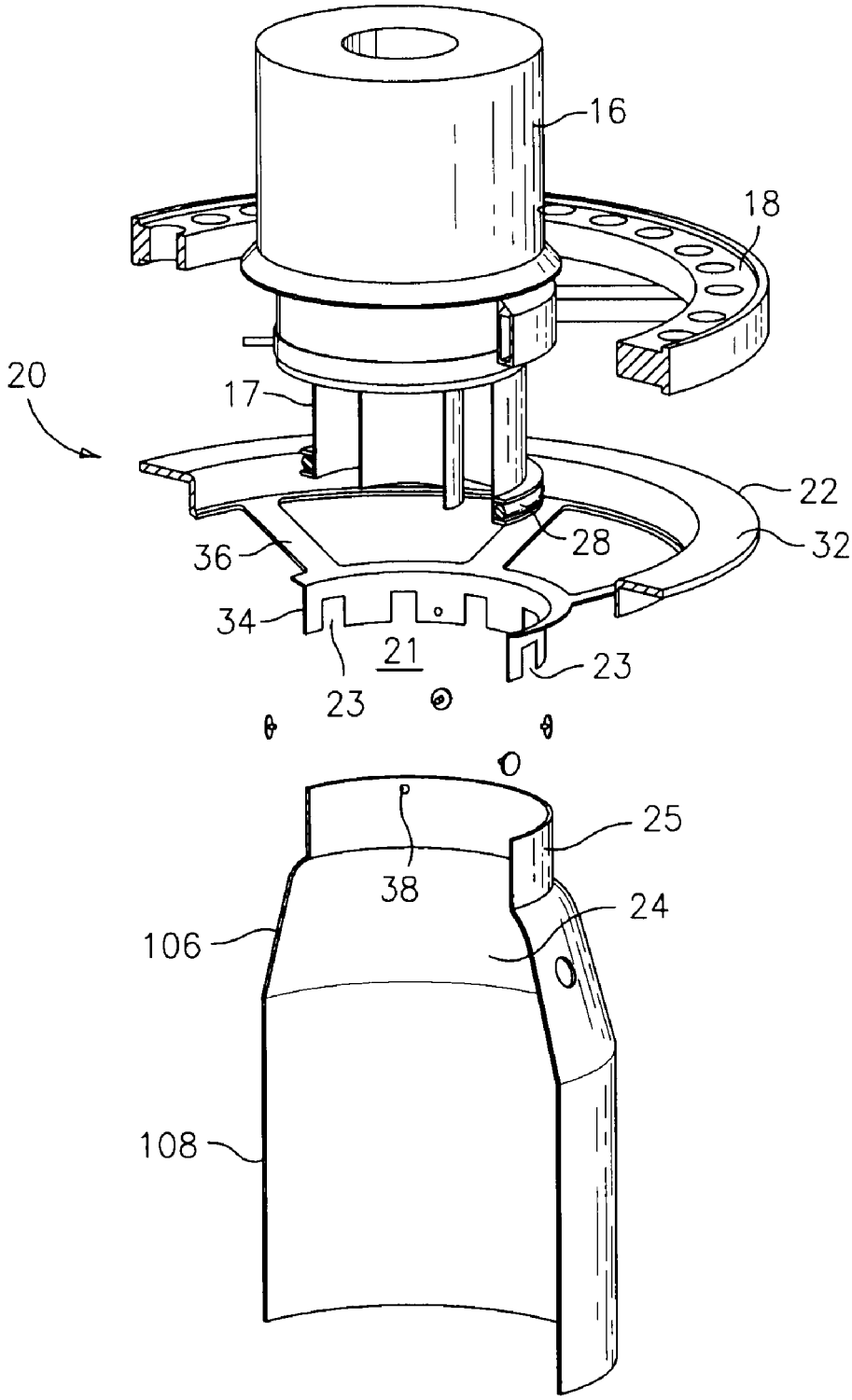
FIG. 2A is an exploded cut-away view of the inner combustion system.
Figure 2B:
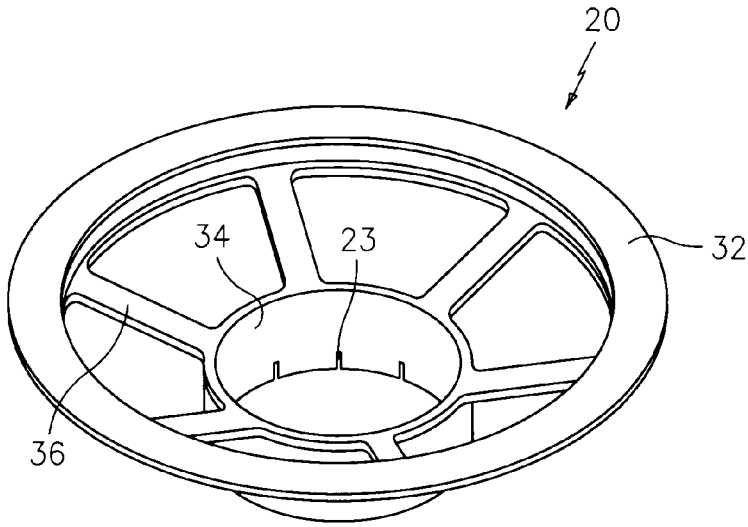
FIG. 2B is a perspective view of the metal support ring showing the main slots.
Figure 5H:
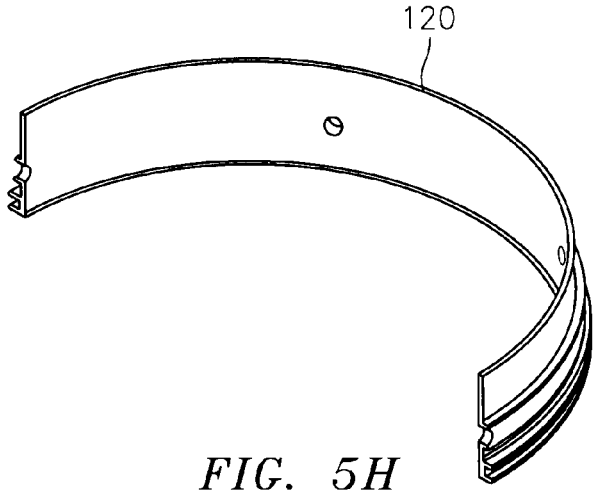
FIGS. 5A-5H illustrate the use of a U-shaped metal ring and corrugated strips as a compliant support.
Figure 3:
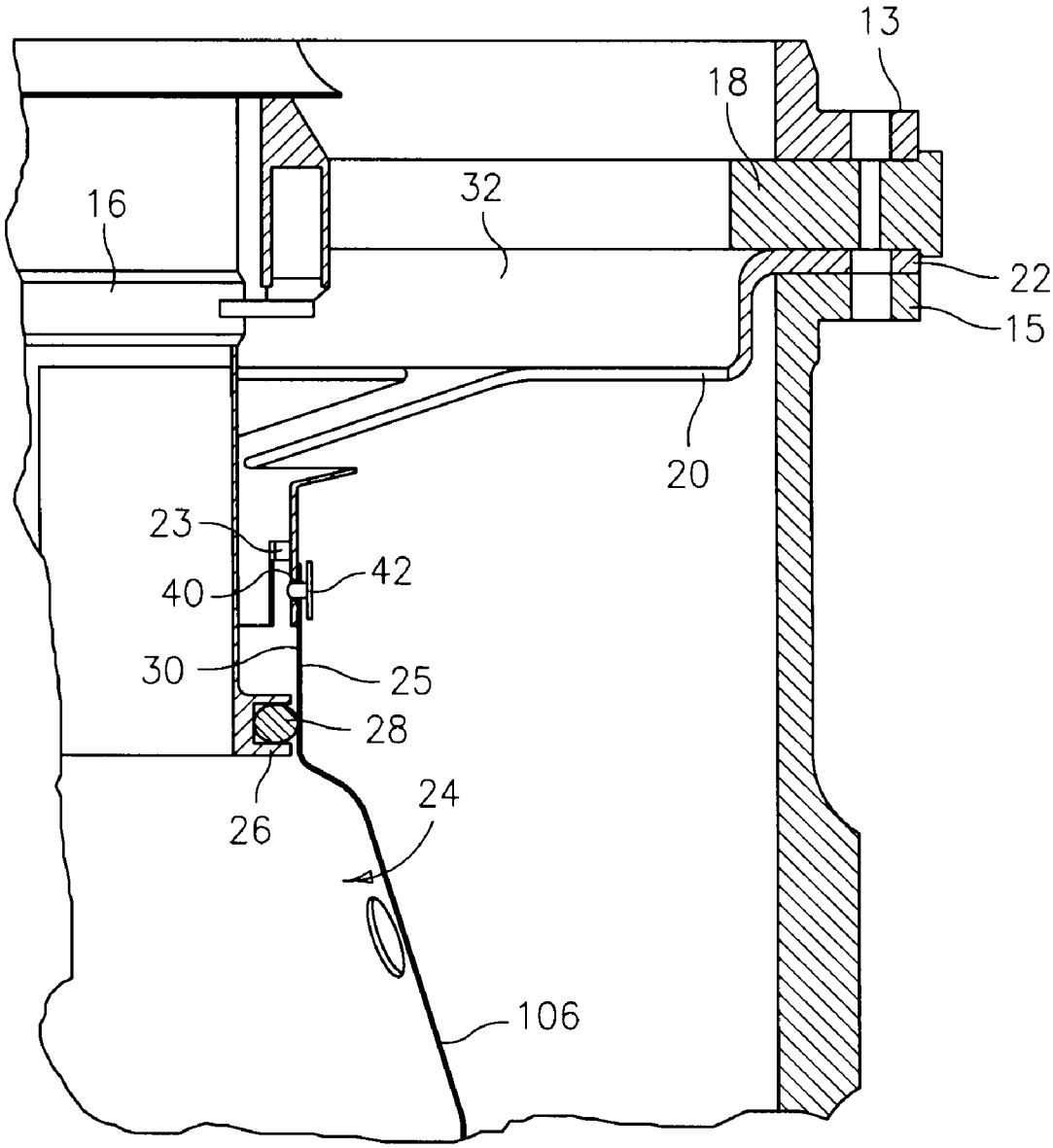
FIG. 3 is a sectional view of a portion of a ceramic liner attachment area.

Referring now to the drawings, FIGS. 1-3 illustrate a first embodiment of a portion of a combustion system of an engine, such as a gas turbine engine. Within the engine, the combustion system is positioned intermediate the compressor section(s) and the turbine section(s) of the engine. In the combustion section, pressurized air is received from the compressor section(s) and mixed with fuel in a known manner.

Referring now to FIG. 1, a combustion system 10 in accordance with the present invention may include an upper metal casing 12, a lower metal casing 14, a fuel air pre-mixer 16, a fuel supply manifold 18, a metal support ring 20 and a ceramic combustor liner 24. FIG. 2 depicts an exploded view of the combustion system 10 of FIG. 1 without the upper and lower metal casings 12 and 14.

As best shown in FIG. 2, the metal support ring 20 has an upper annular member 32 and a lower annular member 34. The upper member 32 and the lower member 34 are joined together by a plurality of spaced radial arms 36. The upper annular member 32 has a shoulder portion 22. The fuel manifold 18 is positioned so that it rests on the shoulder portion 22. As shown in FIGS. 1 and 3, the upper metal casing 12 has a first flange portion 13 and the lower metal casing 14 has a second flange portion 15. The fuel manifold 18 and the shoulder portion 22 are sandwiched between the first and second flange portions 13 and 15. The flange portions 13 and 15 are fastened to each other. Any suitable means known in the art, such as bolts, may be used to fasten the flange portions 13 and 15 together and thereby maintain the fuel manifold 18 and the upper annular member in a fixed position. For example, bolts may pass through aligned openings in the flange portions 13 and 15, the fuel manifold 18, and the shoulder portion 22 if desired.

The pre-mixer 16 is positioned within the casings 12 and 14 so that a lower portion 17 passes through a central opening 21 in the lower annular member 34. The pre-mixer is seated within a neck portion 25 of the ceramic combustor liner 24. As can be seen in FIG. 3, the pre-mixer 16 has a C-shaped channel 26 adjacent its lower end. Seated within the C-shaped channel 26 is a sealing element 28, such as a rope seal. The sealing element 28 which against an inner surface 30 of the neck portion 25 of the ceramic combustor liner 24 to create a seal between the pre-mixer 16 and the ceramic combustor liner 24.

The metal support ring 20 provides both radial and axial support to the ceramic combustor liner 24. The dimensional tolerance is set such that a slip fit exists between the metal support ring 20 and the ceramic combustor liner 24 at room temperature. At elevated temperatures, the metal support ring 20 expands more than the ceramic combustor liner 24 and results in interference between the two. The interference generates tensile hoop stress in the ceramic combustor liner 24 and is detrimental to the mechanical integrity of the ceramic combustor liner 24. To minimize the stress and to increase the compliance, the metal support ring 20 has a plurality of spaced apart, axial slots 23 formed in the lower member 34. As can be seen in FIGS. 2A and 2B, the axial slots 23 are U-shaped and open at their bottom end. The provision of the U-shaped and open axial slots 23 allows relative movement between the metal support ring 20 and the ceramic combustor liner 24.

The ceramic combustor liner 24 is provided with a plurality of spaced apart openings 38 in the neck portion 25. Each opening 38 aligns with a respective one of the axial slots 23. The ceramic combustor liner 24 may be joined to the metal support ring 20 by passing a plurality of fastening means 40 through the holes 38 and through the aligned axial slots 23. Metal bushings 42 may be placed around the fastening means 40, if needed, to spread the contact load between the fastening means 40 and the ceramic combustor liner 24. Any suitable fastener known in the art, such as a bolt or a pin, that provide axial and circumferential support to the liner 24 may be used for the fastening means 40. The fastening means 40 are preferably screwed on the metal support ring 20.

Figure 4:
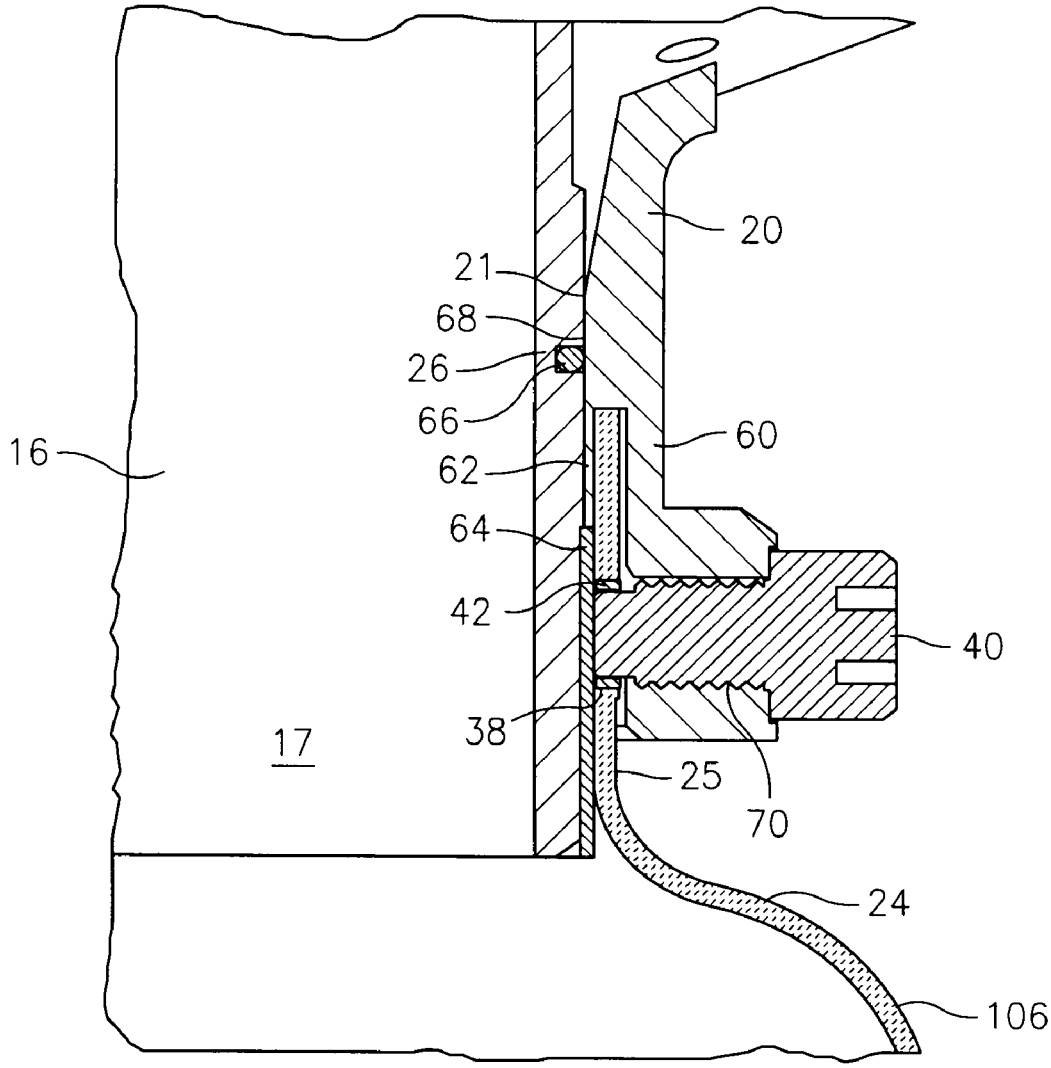
FIG. 4 illustrates a double metal wall attachment method for a ceramic combustor liner.

FIG. 4 illustrates a variation of the combustion system shown in FIGS. 1-3. Instead of a single walled metal support ring, the metal support ring 20 has a double wall construction. At room temperature, the neck portion 25 of the ceramic combustor liner 24 is in contact with an outer wall 60 of the metal support ring 20. At elevated temperatures, the ceramic combustor liner 24 is in contact with an inner wall 62 of the metal support ring 20. The diameters of the inner and outer walls 62 and 60 respectively are such that a slide fit exists at room temperature and only slight interference exists at elevated temperatures. Both walls 60 and 62 may be provided with axial slots (not shown) to reduce stiffness.

As shown in FIG. 4, the lower portion 17 of the pre-mixer 16 is positioned within a central opening 21 in the support ring 20. The pre-mixer 16 has a C-shaped channel 26 in an outer surface 64. A sealing element 66, such as a piston ring, is located within the C-shaped channel 26. In use, the sealing element 66 forms a seal against an inner surface 68 of the metal support ring 20.

To fasten the metal support ring 20 to the ceramic combustor liner 24, a plurality of threaded bores 70 may be provided about the circumference of the outer wall 60 of the metal support ring 20. The neck portion 25 may have a plurality of openings 38 which align with the bores 70. A fastener 40 may be inserted into each bore 70 and into each opening 38. If desired, each fastener 40 may have an external thread which mates with an internal thread in the a respective bore 70. Each fastener 40 may be a metal bolt or any other suitable fastener known in the art. If desired, a bushing 42 may be placed around the fastener 40.

Figure 5A:
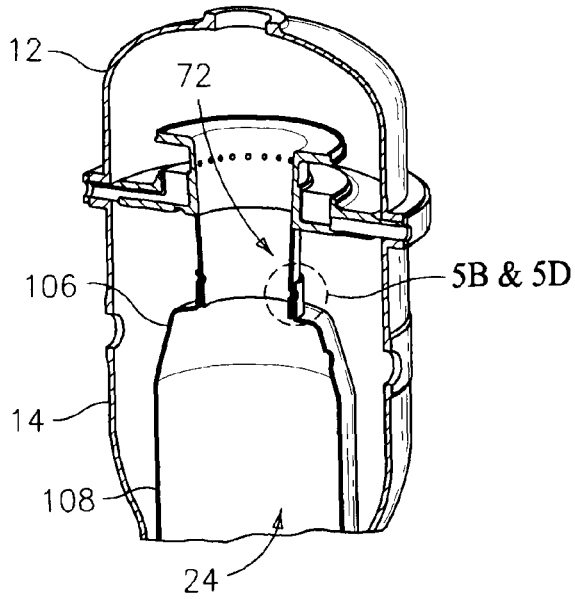
Figure 5B:
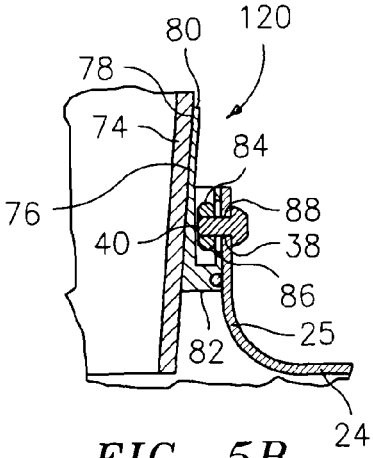
Figure 5C:
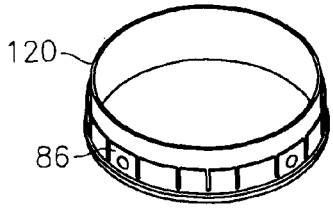
Figure 5E:
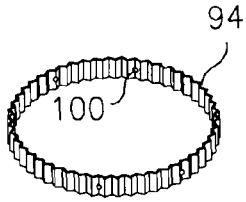
Figure 5D:
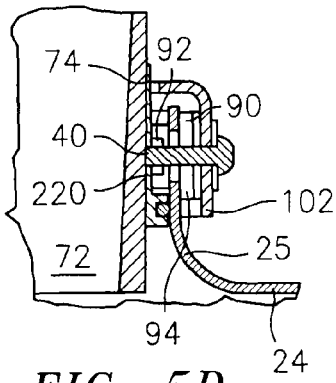
Figure 5F:
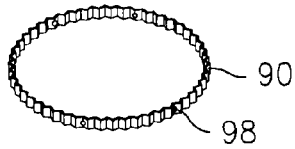
Figure 5G:
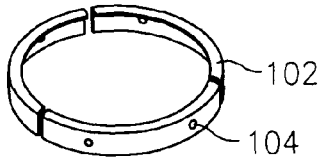

FIGS. 5A-5H illustrate still other embodiments of a combustor system in accordance with the present invention. In the embodiment of FIG. 5A, there is a mixer 72 and a ceramic combustor can or liner 24. As shown in more detail in FIGS. 5B, 5C, and 5H, the mixer 72 may have an inclined surface 74. A shaped metal support ring 120 may be used to support an inside diameter of the ceramic combustor liner 24. The metal support ring 120 may have a planar member 76 that has a surface 78 which rests against an undercut 80 in the mixer 72. The support ring 120 may further have an outer metal lip 82 that contacts the ceramic combustor liner 24. Within the metal lip 82, there is a C-shaped channel 84 and a plurality of compliant taps 86 placed over the channel 84. Each of the taps 86 is provided with an opening 88. The openings 88 about the support ring 120 align with the openings 38 in the neck portion 25 of the ceramic combustion liner 24. To join the ceramic combustion liner 24 to the support ring 120, a fastener 40 is placed through the openings 38 and the openings 88. Each fastener may comprise any suitable fasteners known in the art, such as a metal bolt. The metal taps 86 behave like beams. When the taps 86 are loaded, they bend like beams. For a given load, the amount of bending is controlled by the tap material stiffness, tap length, width and height. Therefore to increase the degree of compliance of the taps 86, one can choose a soft material, increase tap length and/or reduce tap width and height. Compliant taps 86 enable large deformation to accommodate thermal growth mismatch without creating high loading. Such an arrangement may be more compliant than the metal ring configurations shown in the embodiments of FIGS. 1-4.

Referring now to the embodiment of FIGS. 5D through 5G, a metal support ring 220 may be positioned adjacent the surface 74 of the mixer 72. Instead of using axial slots to provide compliance, a corrugated, outer spring element 90 may be placed between the metal support ring 220 and the inner surface 92 of the ceramic liner 24. A corrugated, inner spring element 94 may be placed adjacent an outside surface 96 of the ceramic liner 24. Each of the spring elements 90 and 94 may have an end cut so that they are free to extend under compression and are therefore segmented. Further, each of the spring elements 90 and 94 may have a plurality of spaced apart openings 98 and 100 respectively. An outer segmented clamping ring 102 is provided to hold the corrugated spring elements 90 and 94 and the combustor liner 24 together. As can be seen from FIG. 5G, the clamping ring 102 also has a plurality of spaced apart openings 104. When properly positioned, the openings 104 align with the openings 98 and 100 and the openings 38 in the neck portion 25 of the ceramic combustor liner 24. A plurality of fasteners 40 may be used to join the clamping ring 102 to the spring elements 90 and 94 and to the ceramic combustor liner 24. The fasteners 40 may comprise any suitable fastener known in the art, such as metal bolts. The axial support for the ceramic combustor liner 24 comes from the fasteners 40, and friction resulting from the interference at temperature between the liner 24 and the metal support ring 220. Metal bushings (not shown) may be inserted into the openings to spread the contact load between the fasteners 40 and the ceramic combustor liner 24. The metal bushings may be sized to be smaller than the diameter of the openings so that no interference situation exists between the bushings and the openings in the ceramic liner 24 at elevated temperatures during engine operation.

Since the thermal stress produced by thermal growth differential is proportional to the structural stiffness, temperature rise and difference in the CTE, the ceramic combustor liner may be attached to metal cones, as will be discussed hereinafter, at a region that experiences lower temperatures compared to the rest of the ceramic combustor liner. Additionally, the metal support rings of the embodiments discussed hereinabove can be made of low CTE materials such as IN909 and IN783. To reduce structural stiffness of the metal support rings, axial slots may be introduced as discussed above. If a further reduction in structural stiffness is desired, a material with low Young's modulus, thin wall thickness, increased and longer slots can be considered for the metal support ring(s). Although low structural stiffness is critical in managing the thermal stress, high structural stiffness is required to maintain resistance to resonance in the ceramic combustor liner due to engine vibration. Therefore, caution should be exercised to strike a fine balance between resistance to thermal stress and resistance to structural resonance.

The ceramic combustor liner 24 illustrated in the embodiments of FIGS. 1-5G may consist of three segments—a neck portion 25 formed by a small diameter cylinder at the attachment area, a dome portion 106, and a large cylinder portion 108. Together, the three segments form an integral ceramic combustor liner. The neck portion 25 formed from the smaller cylinder could be locally thickened to provide extra strength at the attachment area. The rest of the ceramic combustor liner 24 may have a uniform thickness.

Figure 6:
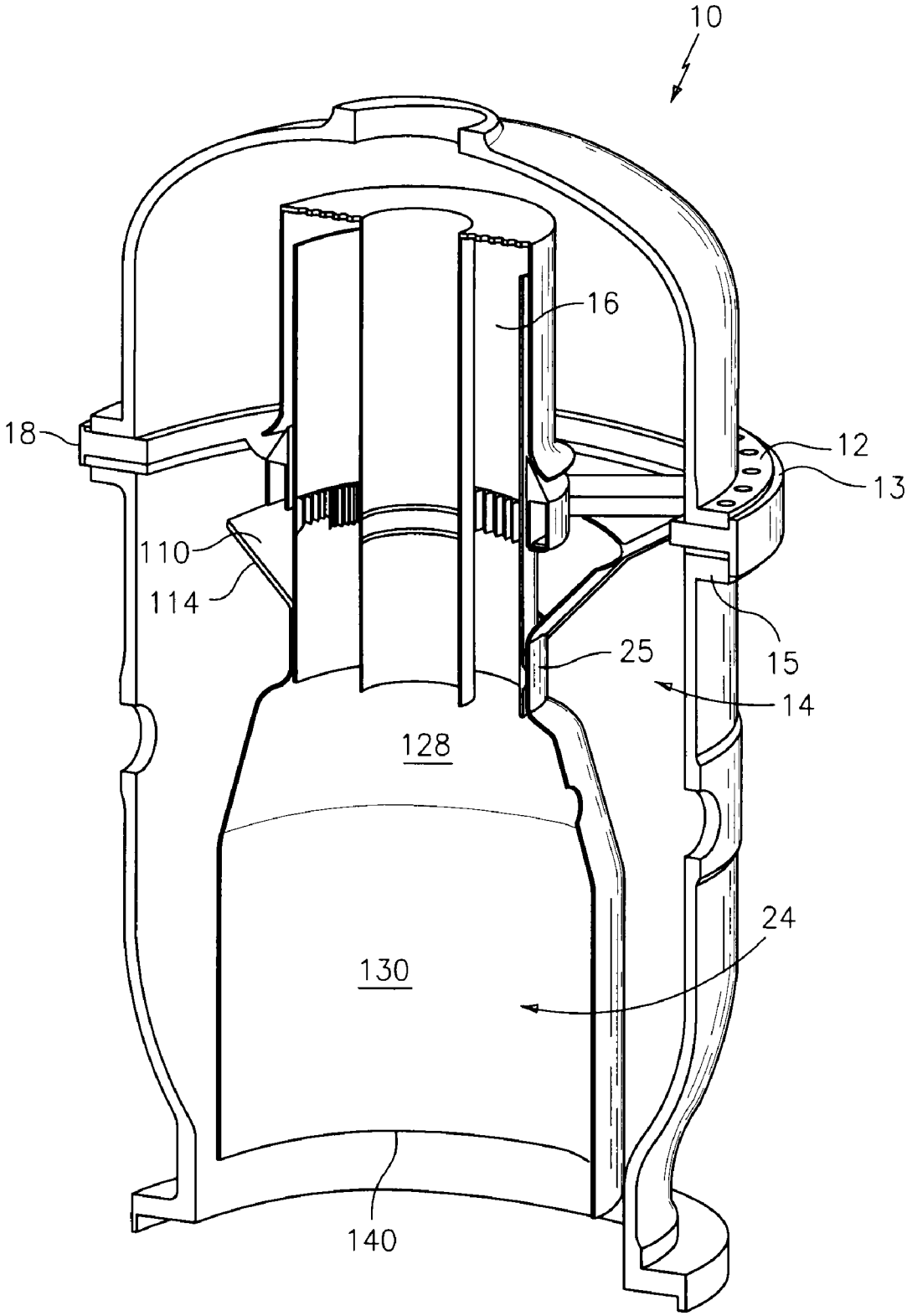
FIG. 6 illustrates an alternative embodiment of a ceramic combustor liner inside a metal casing.
Figure 7:
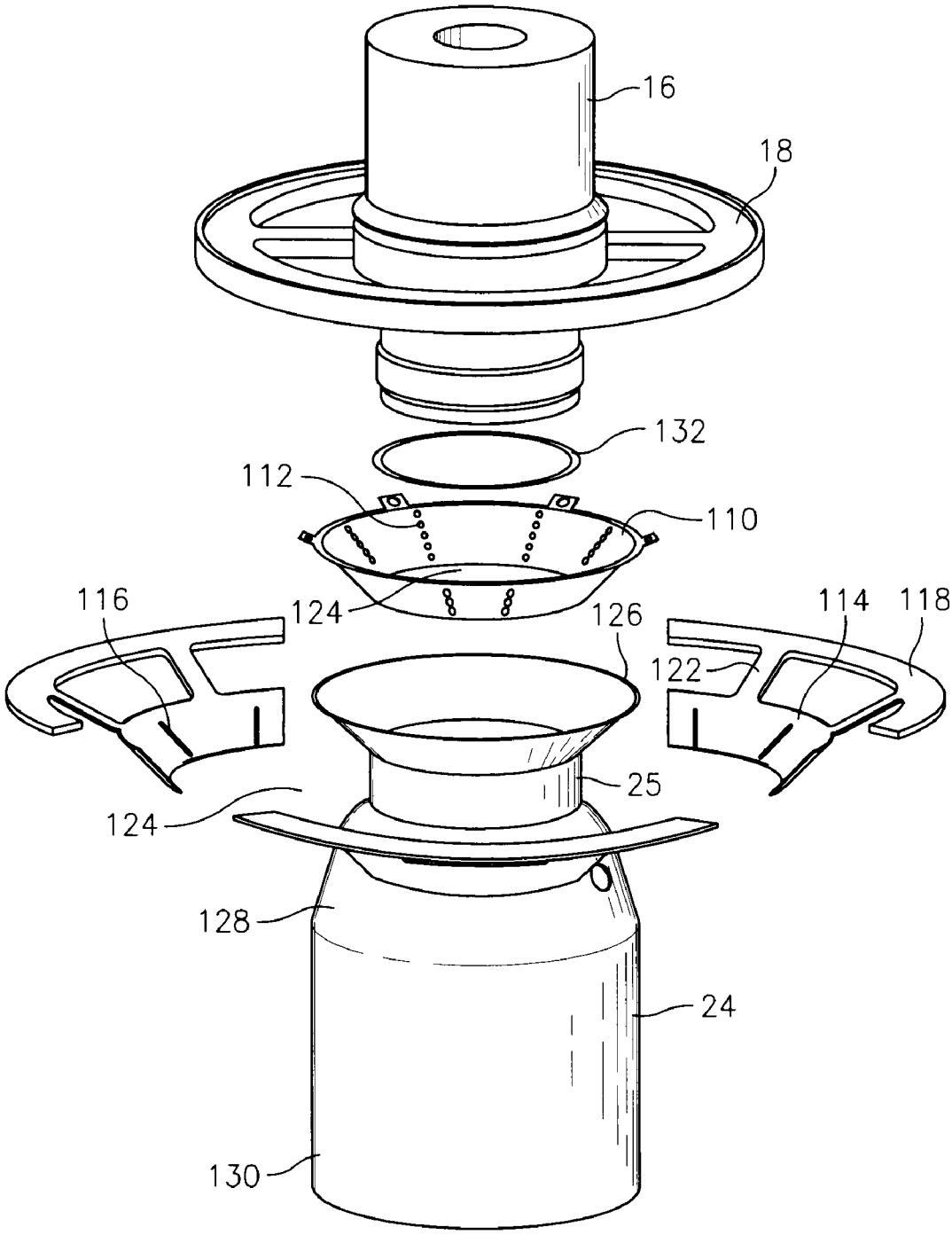
FIG. 7 is an exploded view of the inner combustion system of FIG. 6.
Figure 8:
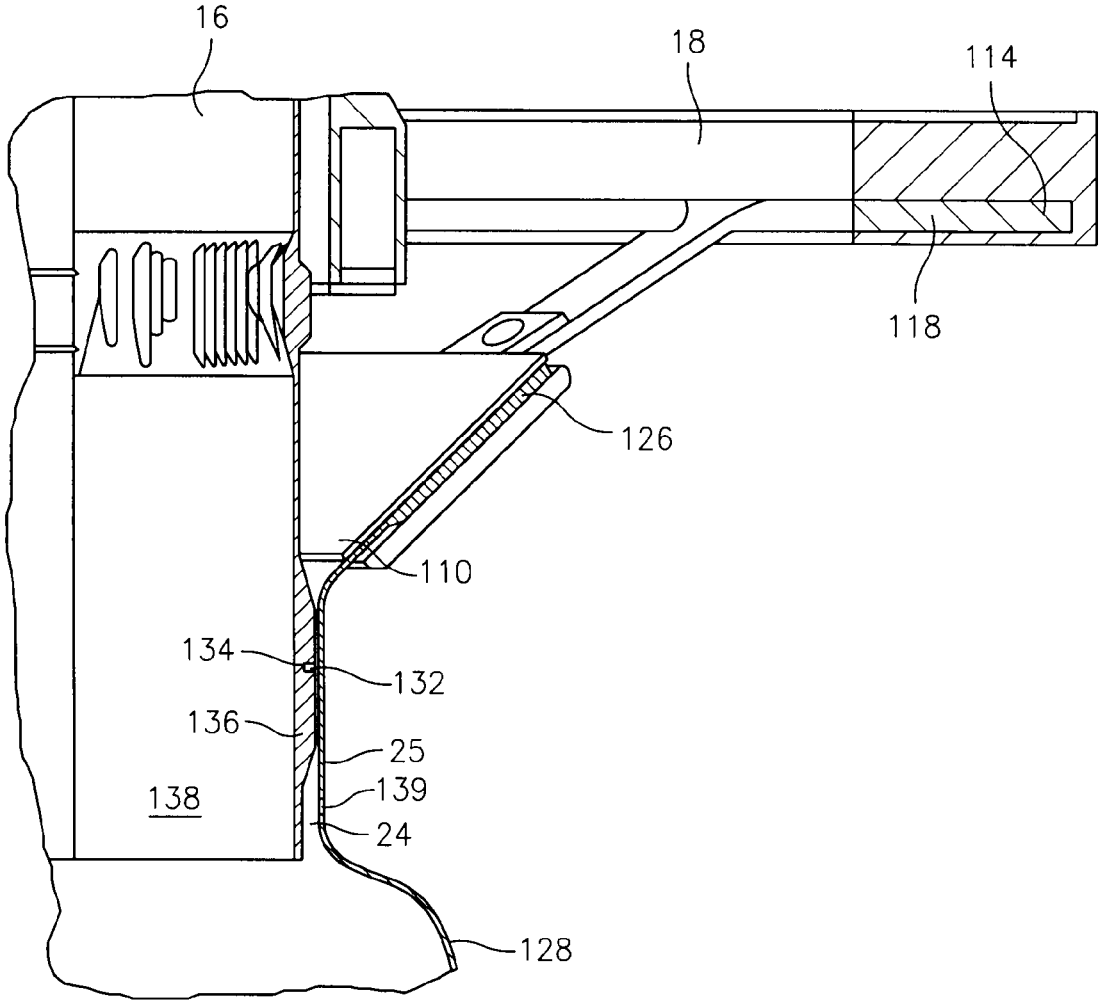
FIG. 8 illustrates a portion of a ceramic liner attachment area in the embodiment of FIG. 6.

Referring now to FIGS. 6-8, there is shown another embodiment of a combustion system 10 in accordance with the present invention. The combustion system 10 includes an upper metal casing 12, a lower metal casing 14, a fuel air pre-mixer 16, a fuel manifold 18, and a ceramic combustor liner 24. The attachment scheme for the ceramic combustor liner 24 includes an inner continuous metal cone 110 with radial slots 112, and an outer segmented metal cone 114 with radial slots 116.

The outer metal cone 114 is sandwiched between the fuel manifold 18 and the lower metal casing 14. The outer metal cone 114 preferably has the same number of spokes 122 as the fuel manifold 18 so as to cause minimal disruption of the airflow external to the fuel air pre-mixer 16. The outer metal cone 114 has a shoulder portion 118 attached to the spokes 122. As can be seen from FIG. 6, the fuel manifold 18 may rest in whole or in part on the shoulder portion 118. Further, the upper metal casing 12 has a first flange portion 13 and the lower metal casing has a second flange portion 15. In a preferred embodiment, a portion of the fuel manifold 16 and the shoulder portion 118 are positioned between the first flange portion 13 and the second flange portion 15. If desired, the flange portions 13 and 15 may be fastened to each other. For example, each of the flange portions 13 and 15, the fuel manifold 18, and the shoulder portion 122 may have aligned openings through which a fastener, such as a bolt, may be passed.

The outer cone 114 may consist of three segments to assist assembly of the combustion system 10. More or fewer segments are possible if desired. The material for the outer cone 114 is preferably chosen to be the same as the material forming the lower metal casing 14 to minimize the thermal fight between the two components.

As can be seen from FIGS. 6-8, each of the cones 110 and 114 has a central opening 124. This allows the fuel air pre-mixer 16 to be positioned against the ceramic combustor liner 24.

As can be seen from FIG. 8, the ceramic combustor liner 24 has a flared-out cone portion 126 at the attachment area. The cone portion 126 is positioned between the inner metal cone 110 and the outer metal cone 114. The inner metal cone 110 is preferably fastened to the outer cone 114, using any suitable fastening means known in the art, after the ceramic combustor liner 24 is placed between the cones 110 and 114.

Figure 9:
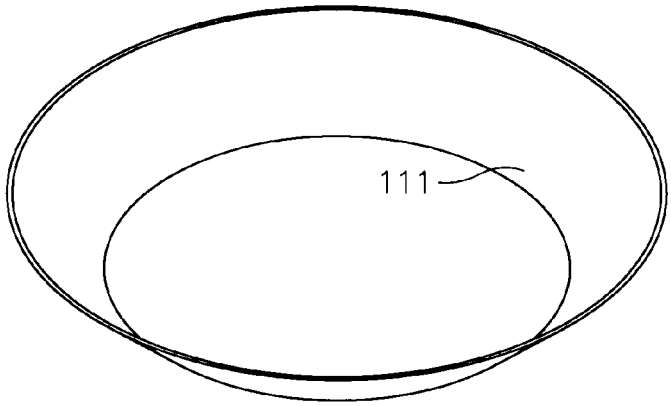
FIG. 9 illustrates an insulating ring.

While the inner cone 110 is preferred to be continuous, it too may be formed from a plurality of segments if desired. Insulating material 111, as shown in FIG. 9, may be inserted between the cones 110 and 114 and the ceramic combustor liner 24 to prevent heat flow from the ceramic combustor liner 24 to the cones 110 and 114 and potential reaction between the ceramic combustor liner 24 and the cones 110 and 114. Preferably, the insulating material 111 is compliant and easily deformable to distribute the clamping force uniformly onto the ceramic combustor liner 24.

The initial gap between the cones 110 and 114 may be set to be smaller than the flared-out conical portion 126 of the ceramic combustor liner 24. In this way, a compressive clamping force may be introduced during assembly and maintained during engine operation. The clamping force is preferably such that relative movement between the ceramic combustor liner 24 and the cones 110 and 114 is possible when the combustion system 10 cycles up and down in temperature. This relative movement relieves thermal stress build-up between the cones 110 and 114 and the ceramic combustor liner 24.

The conical construction of this embodiment allows accurate locating of the ceramic combustor liner 24 during assembly and maintains ceramic combustor liner concentricity during engine operation. It also accommodates thermal expansion mismatch during engine operation.

The ceramic combustor liner 24 may consist of four segments—the flared-out cone portion 126 at the attachment area, a neck portion 25 formed by a smaller straight cylinder, a dome portion 128, and a large cylindrical portion 130. Together, they form an integral ceramic combustor liner 24. The flared-out cone portion 126 may be thickened to provide extra strength. The rest of the ceramic combustor liner 24 may have a smaller thickness. It also provides a convenient means to balance the thrust load on the ceramic combustor liner 24 due to the pressure drop through the fuel air pre-mixer 16. Such a design eliminates the need for fastening holes that can be sources of stress risers.

The fuel air pre-mixer 16 may be made of a high temperature alloy. Its high CTE compared to the ceramic combustor liner's CTE may lead to interference and overloading of the ceramic combustor liner 24 at temperature. Therefore, the initial gap needs to be sized such that no such interference and overloading will occur at all engine conditions. This is achieved by statistical component stack-up analysis. To plug this gap, a sealing element 132, such as a piston ring, may be positioned within a C-shaped channel 134 in the wall 136 of the pre-mixer 16 and positioned within the fuel air pre-mixer 16 and the neck portion 25 of the ceramic combustor liner 24. The fuel air pre-mixer 16 may be locally thickened where the sealing element 132 is situated. The extra thick portion of the pre-mixer 16 helps to reduce leakage through the gap. Ramps (not shown) may be introduced to facilitate the sealing element 132 sliding into its sealing channel 134.

The exit end 138 of the fuel air pre-mixer 16 is exposed directly to the hot gas flame. To avoid overheating, the wall at the exit end 138 should be thin and cooled from the backside. The large number of holes 139 insures even distribution of cooling air.

The ceramic combustor liner 24 is supported at the flared out cone portion 126 only. The exit end 140 of the ceramic combustor liner 24 is free to slide in and out of a combustor transition duct with finger seals. This arrangement prevents jamming and other modes of deformation that could potentially damage the ceramic combustor liner 24. Additionally, a sealing element, such as a piston ring, can be placed between the ceramic combustor liner 24 and the transition duct to reduce leakage of compressor discharge air into the duct, which is detrimental to the $NO_x$ emission of the combustion system.

The various combustion system embodiments shown herein provide several advantages. For example, the embodiments have (1) means that control the thermal stress by structural members with predefined stiffness; (2) a predefined structural stiffness that can be the results of structure material and/or geometrical dimensions of the structural member; (3) means to spread the local contact stress in the attachment area by using a compliant interface layer; (4) means to stop the reaction between a ceramic member and a metal structure by using an interface layer that is chemically non-reacting to both the ceramic and the metal member; and (5) means to reduce the heat flow by a heat insulating interface layer between the ceramic member and the metal structure.

It is apparent that there has been provided in accordance with the present invention a compliant metal support for a ceramic combustor liner in a gas turbine engine which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A combustion system for an engine comprising:

a ceramic component;

at least one metal support component for providing radial and axial support to said ceramic component; and said at least one metal support component having means for minimizing stress and for increasing compliance of said metal support component with respect to said ceramic component, wherein said ceramic component comprises a ceramic combustor liner and said at least one metal support component comprises an outer metal cone and an inner metal cone and wherein said stress minimizing and compliance increasing means comprising a plurality of radial slots in each of said cones, and wherein said outer metal cone has a shoulder portion and further comprising a fuel supply manifold in contact with said shoulder portion.

2. A combustion system according to claim 1, wherein said inner metal cone is continuous and said outer metal cone is segmented.

3. A combustion system according to claim 1, further comprising an upper metal casing having a first flange portion and a lower metal casing having a second flange portion and said fuel supply manifold and said shoulder portion being located between said first flange portion and said second flange portion.

4. A combustion system according to claim 3, further comprising said first flange portion being fastened to said second flange portion.

5. A combustion system according to claim 1, further comprising each of said cones having a central opening and a fuel air pre-mixer passing through said central opening and having an outer surface in contact with an inner surface of said ceramic combustor liner.

6. A combustion system according to claim 5, further comprising a C-shaped channel in said outer surface of said fuel air pre-mixer and means positioned within said C-shaped channel for creating a seal between said fuel air pre-mixer and said inner surface of said ceramic combustor liner.

7. A combustion system according to claim 6, wherein said seal means comprises a piston ring.

8. A combustion system according to claim 1, wherein said outer metal cone has at least three segments.

9. A combustion system according to claim 1, further comprising a lower metal casing and wherein said outer metal cone is formed from a material identical to a material forming said lower metal casing.

10. A combustion system according to claim 1, wherein said outer metal cone is fastened to said inner metal cone.

11. A combustion system according to claim 1, further comprising insulating material inserted between said cones and said ceramic combustor liner to prevent heat flow from the ceramic combustor liner to said cones.

12. A combustion system according to claim 11, wherein said insulating material is compliant and deformable.

13. A combustion system according to claim 1, further comprising said ceramic combustor liner being movable relative to said cones as said combustion system cycles up and down in temperature so as to relieve thermal stress build-up.

14. A combustion system according to claim 1, further comprising said ceramic combustor liner having a flared-out cone portion sandwiched between said inner metal cone and said outer metal cone.

15. A combustion system according to claim 14, wherein said ceramic combustor liner has a straight cylinder portion adjacent said flared-out cone portion, a dome portion adjacent said straight cylinder portion, and a larger diameter cylinder portion adjacent said dome portion.

* * * * *